United States Patent [19]

Dlugosz

[11] Patent Number: 4,506,789

[45] Date of Patent: Mar. 26, 1985

[54] CHILD RESISTANT PACKAGE

[75] Inventor: Jeffrey Dlugosz, Philadelphia, Pa.

[73] Assignee: Packaging Coordinators, Inc., Philadelphia, Pa.

[21] Appl. No.: 509,360

[22] Filed: Jun. 30, 1983

[51] Int. Cl.[3] ..... B65D 83/04; B65D 85/56

[52] U.S. Cl. ..... 206/532; 206/534.1; 206/539; 206/469; 206/475; 206/484

[58] Field of Search ..... 206/532, 534.1, 539, 206/469, 472, 475, 484

[56] References Cited

U.S. PATENT DOCUMENTS

| | | | |
|---|---|---|---|
| 2,968,391 | 1/1961 | Sparks | 206/532 |
| 3,811,564 | 5/1974 | Braber | 206/469 |
| 3,835,994 | 9/1974 | Haines | 206/484 |
| 3,872,970 | 3/1975 | Edison | 206/532 |
| 3,912,082 | 10/1975 | Gerner et al. | 206/484 |
| 3,924,747 | 12/1975 | Gerner | 206/484 |
| 4,125,190 | 11/1978 | Darie, Jr. et al. | 206/532 |
| 4,243,144 | 1/1981 | Margulies | 206/532 |
| 4,422,551 | 12/1983 | Pawlowski | 206/475 |

*Primary Examiner*—William T. Dixson, Jr.
*Assistant Examiner*—Brenda J. Ehrhardt
*Attorney, Agent, or Firm*—Caesar, Rivise, Bernstein & Cohen, Ltd.

[57] ABSTRACT

A child-resistant package includes a sealed blister positioned between opposed front and back paperboard sheets that are adhered to each other. The front paperboard sheet includes openings through which the blisters project, and the back paperboard sheet includes a tear strip overlying the blister and being movable in a linear direction to permit its separation from surrounding regions of the back sheet to thereby expose a rupturable backing strip of the sealed blister, there being no other blisters linearly aligned with the linear direction in which the tear strip is movable.

4 Claims, 7 Drawing Figures

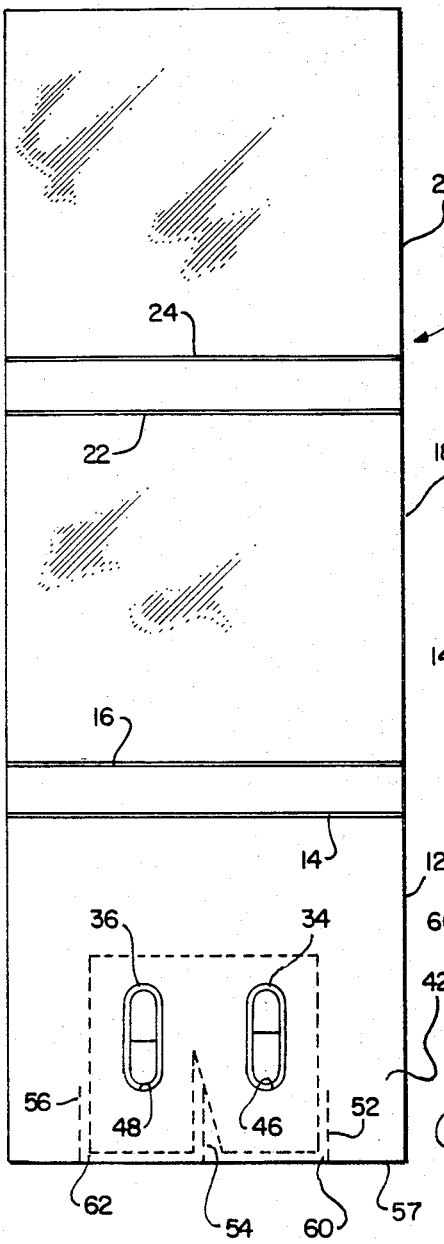
FIG. 1
FIG. 3
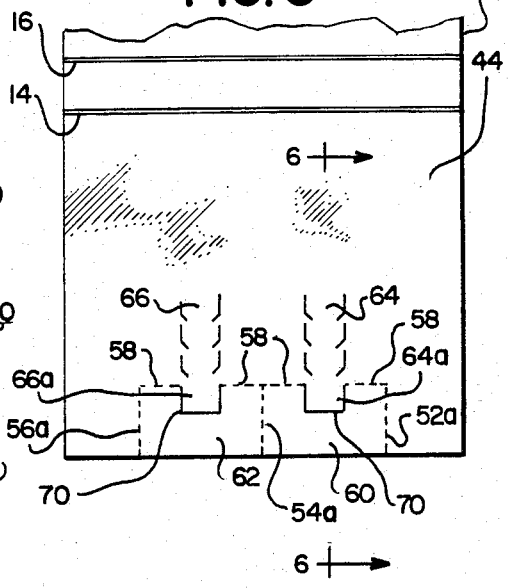
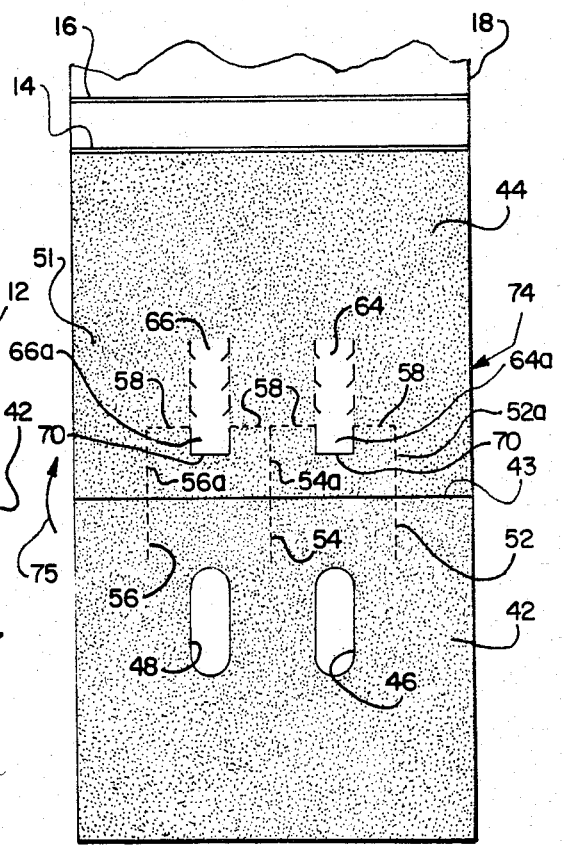
FIG. 7

FIG. 2
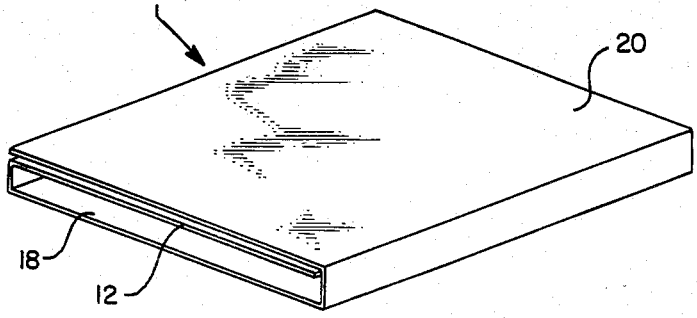
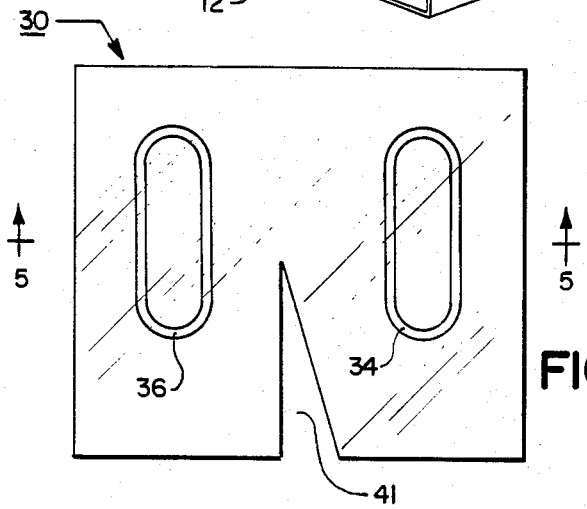
FIG. 4
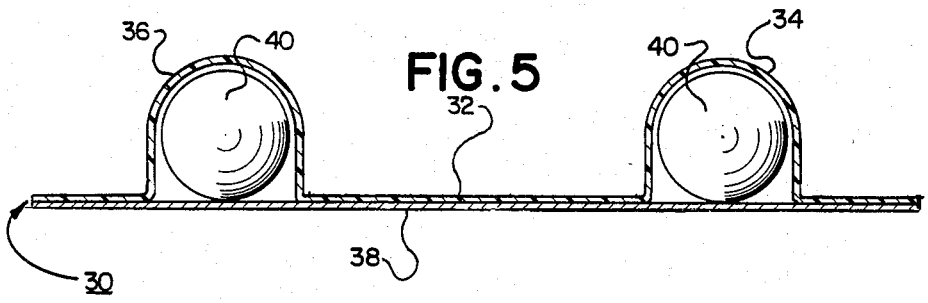
FIG. 5
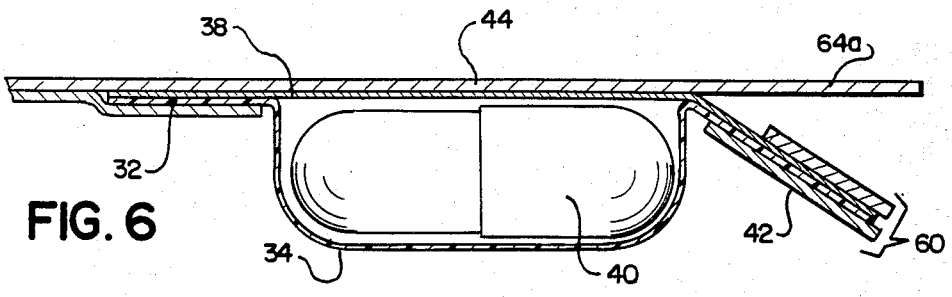
FIG. 6

CHILD RESISTANT PACKAGE

This invention relates generally to child-resistant packages, and more particularly, to child-resistant blister packages for medicaments or the like, preferably in capsule, lozenge or pill form.

Blister packages, particularly of the child-resistant type, have become quite popular in recent years for the packaging of medicaments in capsule, lozenge or pill form. Generally the contents of these packaging systems are visible through clear plastic blisters. Often these medicaments are brightly colored, and children are readily attracted to them; thereby creating a substantial risk of injury, or even death, if the child succeeds in opening the package and injesting the contents thereof. Therefore, there is a considerable demand for child-proof packages which are just too difficult to open by children that are too young to realize the potential hazards associated with the use of the packaged drugs, yet which are quite easily openable by an adult.

One approach to forming a child-proof package is disclosed in U.S. Pat. No. 3,912,082, issued to Gerner et al and assigned to the assignee of the instant application. In this package removable tabs are provided in the bottom paperboard layer to permit exposure, upon removal, of a rupturable foil backing closing the openings into the blisters. In order to impede access to the tabs a separate, peelable film backing is adhered to the paperboard backing sheet in overlying relationship with said tabs. The use of such a separate film backing inherently increases the cost of the package and the complexity of its fabrication, as compared to a package in which a separate film backing is not used.

Moreover, the arrangement of the tabs inwardly of the marginal edges of the backing sheet, as disclosed in the '082 patent, may actually make it too difficult for some adults (e.g. those afflicted with arthritis) to manipulate the package in the manner required for dispensing the medicament. This may actually be the case even if the package were fabricated without the separate film backing.

A further deficiency of the package disclosed in the '082 patent resides in the manner in which the various blisters are located relative to the removable tabs in the bottom paperboard layer. Specifically one or more tabs are adapted to be pulled away from surrounding regions of the paperboard layer, preparatory to dispensing a medicament from a blister, in a linear direction aligned with at least two blisters. Therefore, even though a separate tab is provided for each blister, a child that inadvertently gains access to a single tab and pulls it may, if that tab is linearly aligned with several blisters, expose the foil layer associated with each of said aligned blisters. This creates an increased risk of an overdose occuring as compared to using a package which is designed to avoid the undesired exposure of several blisters when only a single tab, or tear strip is removed.

A somewhat different approach to forming a child-resistant blister package is disclosed in U.S. Pat. No. 4,125,190, issued to Davie, Jr. et al. In this package a foil-backed blister sheet is sandwiched between an upper paperboard sheet and an intermediate paperboard sheet, each being provided with a plurality of openings therethrough adapted to align with a plurality of blisters in the blister sheet. A separate, or third paperboard sheet is positioned beneath the intermediate sheet to cover the openings through it, and is adhered directly to marginal areas of the top paperboard sheet. This third sheet is provided with a removable tear strip separable therefrom to expose the several openings in the intermediate paperboard sheet, and accordingly, to permit the medicaments in the several aligned blisters to be forced through the rupturable foil backing aligned with such openings. Again, as is the case with the package disclosed in the '082 patent, the inclusion of the third sheet in the package increases both material costs and the complexity of fabrication, as compared to a package wherein an additional, or third sheet is not needed. Moreover, since several blisters are aligned with the tear strip, a child that inadvertently gains access to the strip and pulls it can automatically expose the rupturable foil associated with all of the blisters. As is the case with the package disclosed in the earlier-discussed '082, this creates an increased risk of an overdose occurring, as compared to using a package which is designed to avoid exposure of more than one blister by the removal of a single tear strip.

The present invention overcomes the inherent disadvantages of the prior art devices while at the same time providing a very reliable child-proof package.

In accordance with this invention a child-resistant package includes a plastic strip with one or more raised blisters formed therein. These blisters project from one face of the strip and have openings in the opposite face thereof into which medicaments or the like are inserted. When the package includes a strip with more than one raised blister in it, the blisters are aligned in a single linear direction. A relatively rupturable backing strip, preferably a foil sheet, is adhered to the opposite face of the plastic strip and seals the openings into the blisters. In accordance with this invention front and back sheets, preferably formed of a relatively stiff paperboard material, are positioned on opposite sides of the sealed blister and are adhered to each other and to the sealed blister. The front paperboard sheet overlying the one face of the plastic strip includes openings therethrough for receiving the raised blisters. The back sheet, overlying and engaging the rupturable backing strip, includes a separate tear strip means overlying each of the blisters, each said tear strip means being movable in a linear direction for removal from surrounding regions of the back sheet to expose the rupturable backing strip in the region overlying the opening into a blister, there being only one blister linearly aligned with the linear direction in which each tear strip means is movable.

In view of the above arrangement, even if a child does accidentally engage and remove one of the tear strip means, the contents in only one of the blisters will be exposed. The reason why this is so is that each tear strip means is associated with only a single blister, and the linear direction in which said tear strip means is moved to separate it is not aligned with any other blisters. This greatly minimizes the likelihood of a child inadvertently getting an overdose of the packaged drug.

In accordance with the most preferred embodiment of this invention each tear strip is formed in a manner which makes it very difficult to get into the package by individuals lacking the degree of maturity to appreciate the hazards of doing so. More specifically, each of the tear strips includes a leading, or starter end located inwardly of a marginal edge of the package and being adapted to be gripped, when exposed, for permitting easy removal of each tear strip from its position overlying the rupturable backing strip. Each leading end normally is unexposed by being located in substantially the same plane as an adjacent, bendable tab section defined by lines of perforations formed in both the front and back paperboard sheets. All of the tab sections preferably extend to the same marginal edge of the package, and need to be bent out of the generally flat plane occupied by surrounding regions of the front and back paperboard sheets in order to expose the leading ends of associated tear strips. This is a very difficult operation for a child, yet is very easily accomplished by an adult.

In the most preferred embodiment wherein at least two blisters are formed in the unitary plastic strip, said blisters are aligned in a single linear direction, and the separate tear strip for each of the blisters is movable in a linear direction substantially perpendicular to the linear direction of alignment of the blisters. This arrangement provides only one blister linearly aligned with the linear direction in which each of the tear strips is adapted to be moved.

When a unitary strip of two or more blisters is provided in the package, the bendable tab sections associated with the blisters preferably are adjacent to, and separable from each other along overlying lines of perforations formed in the opposed front and back paperboard sheets. Portions of the unitary strip of blisters extend into the bendable tab sections, but the strip is relieved in the region of the overlying lines of perforations so that it is not necessary to also perforate the unitary strip in order to permit the bendable tab sections to be separated from each other.

Other objects of the present invention will become readily apparent by referring to the description of the Best Mode of the Invention which follows, taken in conjunction with the drawings.

FIG. 1 is a plan view of the child-resistant package of this invention, in an opened, substantially planar orientation;

FIG. 2 is an isometric view of the package shown in FIG. 1, but in a folded condition;

FIG. 3 is a fragmentary back view of the package of this invention;

FIG. 4 is a plan view of a sealed blister employed in the package of this invention;

FIG. 5 is a sectional view along line 5—5 of FIG. 4;

FIG. 6 is a sectional view along line 6—6 of FIG. 3, illustrating the manner in which a leading end of a removable tear strip is exposed preparatory to opening the package; and FIG. 7 is a fragmentary plan view of a cardboard blank employed in forming the package of this invention.

Referring to FIGS. 1 and 2, a child-resistant package 10 in accordance with this invention is illustrated as a 3-flap, 2-capsule package. More particularly, the capsules are actually retained in the end flap 12 which is folded along double score lines 14 and 16 into overlying relationship with intermediate flap 18, as illustrated in FIG. 2. Likewise, the opposite end flap 20 is folded along double score lines 22, 24 to also overlie the section 12. If desired, suitable printed material can be included on the exposed surface of the top end flap 20, or for that matter, on any of the exposed surfaces of the folded package.

It should be understood that the arrangement of the elements described thus far is generally a matter of choice; it being within the scope of this invention to vary the number of flaps employed in the package, and, if desired, to form the package of this invention as a generally planar strip, without the inclusion of any foldable cover flaps.

The present invention will now be described in connection with the arrangement of elements associated with the end flap 12.

Turning first to FIGS. 4 and 5, it should be understood that the package of this invention includes a foil-backed blister 30 including a sheet of clear plastic 32 that is vacuum formed to establish blisters 34 and 36 projecting from one face thereof. Any suitable plastic material can be employed to form this sheet 32; however, a 10 mil polyvinyl chloride (PVC) sheet has been used quite succesfully in forming these type of blister packages. The backing strip 38 is formed of a rupturable material, i.e. a material through which the contents of the blister can be forced by compressing the blister in a direction toward the backing strip. A preferred rupturable sheet is aluminum foil, typically 1 mil thick. The foil sheet 38 can be a laminate including a central paper layer sandwiched between thin aluminum film layers. The foil sheet 38 is provided with a heat sealable adhesive, such as polyethylene, and is adhered through this adhesive to the plastic sheet 32 in overlying relationship with the openings into the blisters 34 and 36 after a medicament, such as capsule 40, is inserted therein.

As can be seen in FIG. 4, the sealed blister 30 is relieved at 41 so as to not interfere with the manipulative steps required to remove capsule 40 from the package, as will be described in greater detail hereinafter. Except for the provision of relief area 41, which is quite unique, the sealed blister 30 is formed in a conventional manner from conventional, well-known materials.

Turning specifically to FIGS. 1, 3, 6 and 7, the sealed blister 30 is positioned between opposed front and back paperboard sheets 42 and 44, respectively; preferably bleached sulfate paperboard die-cut in the configuration illustrated in FIG. 7. In particular the sulfate paperboard can be 10 point paper (0.01 inch) in thickness and provided with a coated outer surface readily adaptable to receiving printed matter thereon.

Referring specifically to FIGS. 1 and 7, the top sheet 42 is die-cut to include passages 46 and 48 therethrough. The top sheet is positioned in overlying, contacting engagement with the plastic sheet 32 of the sealed blister 30, with the blisters 34 and 36 projecting through the passages 46 and 48. The inner face 50 of the top sheet is provided with a heat sealable coating thereon, as is illustrated by light stippling in FIG. 7.

The top sheet 42 also is provided with three generally parallel lines of perforations 52, 54 and 56 extending inwardly from a marginal edge 57 of the package, as is illustrated in FIG. 1. The back sheet 44 also has similar parallel lines of perforations **52*a*, 54*a* and 56*a* formed in linear alignment with lines 52, 54 and 56 (FIG. 7) so that they will be disposed in overlying relationship with lines 52, 54 and 56 when the front and back sheets 42 and 44 are adhered together in overlying relationship with each other. Note that the back sheet 44 also includes horizontally extending cuts, or perforations 58 generally bridging the spaced, parallel lines of perforations. This provides hinge regions about which tabs 60 and 62 can be bent individually to expose the leading edges 64*a* and 66*a* of associated tear strips 64 and 66, respectively, as will be explained in greater detail hereinafter. However, it should be noted that the leading edge 64*a*, 66*a* of each tear strip is formed by generally U-shaped cuts 70 projecting into the area of the tabs 60 and 62. Except for the leading edge, each of the tear strips is formed by cuts, which, as illustrated in FIG. 3, are configured in such a way as to diverge from each other in the direction in which the tear strip is pulled and then to run parellel to each other for a slight distance. This configuration is well-known in the packaging art, and counteracts the tendency of the tear strip to taper to a point and thereby become useless. A similar tear strip arrangement is illustrated in U.S. Pat. No. 4,125,190, issued to Davie, Jr., and herein incorporated by reference. However, the tear strip employed herein differs from the Davie, Jr. arrangement by the inclusion of the generally U-shaped lead end extending into the region of the bendable tabs 60 and 62**, for a reason to be explained in greater detail hereinafter.

Referring to FIG. 7, the front and back paperboard sheets 42 and 44 are formed as a single unit from cardboard blank 74 and are foldable about a score line (or other fold-inducing line) 43. This fold line ultimately constitutes the marginal edge 57 of the package, after the front sheet 42 has been folded into overlying relationship with the back sheet 44, in the direction indicated by arrow 75.

Still referring to FIG. 7, a heat sealable adhesive, such as polyethylene, also is applied to inner face 51 of the bottom sheet 44 in all regions except those occupied by the tear strips 64 and 66, as is indicated by the light stippling. After the sealed blister 30 is positioned against the inner face 51 of bottom sheet 44, the top sheet 42 is folded about the score line 43, in the direction indicated by arrow 75, to position the elements as indicated in FIG. 1. Thereafter, the package is placed in a heated platen to activate the heat sealing adhesive, and thereby cause the opposed sheets 42 and 44 to adhere to each other in the regions surrounding the sealed blister 30, and also to adhere to opposed surfaces of the blister, except in the regions of the tear strip 64 and 66.

As can be seen in FIG. 1, the relief area 41 in the blister 30 is located in the region occupied by lines of perforations 54 and **54*a*, which are the lines along which the bendable tabs 60 and 62 are separated from each other to permit their independent manipulation. Note that the sealed blister 30 actually extends into the tabs, and this relief area 41 is necessary in order to prevent the somewhat rigid sealed blister 30 from interfering with the bending of the individual tabs 60 and 62 preparatory to removing a medicament (e.g. capsule 40) from either one or both of the blisters 34 and/or 36**.

In order to remove a capsule 40 from one of the vacuum-formed sealed blisters (e.g. 34), the bendable tab 60 is first separated along aligned lines of perforations 52, **52*a*, and aligned lines of perforations 54, 54*a*. Thereafter, it is bent downwardly, as is shown best in FIG. 6, along horizontal cuts, or perforations 58, formed in the back sheet 44. This exposes the generally U-shaped leading end 64*a* of the tear strip 64 so that it can be gripped easily and pulled in a linear direction generally perpendicular to the direction in which the blisters 34 and 36 are aligned. Removal of the tear strip 64 exposes the rupturable foil sheet 38 in the region overlying blister 34. Thereafter, manual pressure on the blister will force the capsule 40 through the foil sheet in a well-known manner. It should be clearly understood that the tab 62 is manipulated in the same manner as tab 60 preparatory to removing capsule 40 from the other blister 36**.

Removal of each of the tear strips 64 and 66 will only expose the rupturable foil backing associated with a single blister. There are absolutely no other blisters linearly aligned with the direction in which each linear tear strip is pulled to remove it from the package.

It should be apparent that access to the contents within a blister is extremely difficult for a child too young to appreciate the inherent dangers associated with taking drugs. Specifically, in order to gain access to the contents of a particular blister, it first is necessary to separate a bendable tab along associated lines of perforations, and then to bend the tab in order to expose the leading edge of an associated tear strip. The tear strip then needs to be pulled linearly in order to expose the rupturable foil overlying the opening into a blister. Then a downward force needs to be applied to the blister to force the contents therein through the rupturable foil sheet. Although all of these steps are quite easily accomplishable by an adult, the likelihood of a child of tender years actually carrying out these steps is very remote. However, even if a child somehow does remove one of the tear strips, the arrangement of elements in the package will only permit access to the contents within a single blister. This further reduces the likelihood of a child getting an overdose of the packaged drug.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specification, but rather only by the scope of the claims appended hereto.

What is claimed is:

1. A child-resistant package including a unitary plastic sheet having at least two blisters projecting from one face thereof, and having openings into said blisters in the opposite face thereof, said blisters being linearly aligned in a first direction and including medicaments therein, a unitary, rupturable backing strip adhered to said opposite face of the plastic sheet and sealing the openings into the blisters, a front paperboard sheet overlying and engaging said one face of the unitary plastic strip and including openings therethrough into which the blisters extend, a back paperboard sheet overlying and engaging the rupturable backing strip and being adhered to the front sheet in regions surrounding said sealed blisters, said back sheet including a separable tear strip means overlying each blister, each tear strip means being movable in a linear direction substantially perpendicular to the direction of linear alignment of the blisters, said tear strip means including leading ends located inwardly of a common marginal edge of the package, each leading end being adapted to be gripped, when exposed, for permitting easy removal of said tear strip means from surrounding regions of the back sheet to expose the rupturable backing strip in the region overlying the opening into an associated blister, each of said leading ends being normally unexposed by being covered with a bendable tab section defined by lines of perforations along which the bendable tab section can be separated for exposing the leading end of an associated tear strip means, said plastic sheet and rupturable backing strip being partially located in the region of the bendable tab sections and being relieved so as not to be present in regions aligned with lines or perforations along which the bendable tab sections are adapted to be separated.

2. The package of claim 1 characterized in that there is only a single blister linearly aligned with the linear direction in which each of said tear strip means is moved to separate each of said tear strip means from the back sheet.

3. The package of claim 1 characterized in that each bendable tab section covers the leading end of its corresponding tear strip means by being located in substantially the same plane as said corresponding tear strip means.

4. The package of claim 1 wherein said plurality of bendable tab sections extend inwardly from a common marginal edge of the package.

* * * * *